United States Patent [19]

Federighi, Jr. et al.

[11] Patent Number: 4,776,359

[45] Date of Patent: Oct. 11, 1988

[54] UNDER COUNTER GLASS WASHER

[76] Inventors: George B. Federighi, Jr., 1761 Marwest St.; William D. Federighi, #5 St. Lucia St., both of, Tiburon, Calif. 94920

[21] Appl. No.: 806,447

[22] Filed: Dec. 9, 1985

[51] Int. Cl.[4] ..... B08B 3/02

[52] U.S. Cl. ..... 134/111; 134/115 R; 134/181; 134/186; 134/200

[58] Field of Search ..... 134/104, 110, 115 R, 134/172, 174, 176, 179, 180, 181, 186, 188, 191, 195, 200, 111

[56] References Cited

U.S. PATENT DOCUMENTS

| | | | |
|---|---|---|---|
| D. 195,640 | 7/1963 | James | D49/1 |
| D. 210,799 | 4/1968 | Peterson | D49/1 |
| D. 231,484 | 4/1974 | Peterson | D49/1 A |
| 1,646,052 | 10/1927 | Cave | 134/186 X |
| 1,681,322 | 8/1928 | Cave | 134/186 X |
| 1,833,374 | 11/1931 | Renshaw | 134/179 X |
| 2,154,559 | 4/1939 | Bilde | 134/179 X |
| 2,813,534 | 11/1957 | Low | 134/57 |
| 2,907,335 | 10/1959 | Abresch | 134/176 |
| 3,384,099 | 5/1968 | Baumann | 134/115 R |
| 3,419,023 | 12/1968 | Valdespino | 134/179 X |
| 3,465,761 | 9/1969 | Meeker et al. | 134/176 X |
| 3,582,173 | 8/1969 | Noren et al. | 312/319 |
| 3,598,130 | 8/1971 | Nolte et al. | 134/172 X |
| 4,218,264 | 8/1980 | Federighi | 134/95 |

FOREIGN PATENT DOCUMENTS

| | | | |
|---|---|---|---|
| 2360399 | 6/1974 | Fed. Rep. of Germany | 134/115 R |
| 10194 | of 1912 | United Kingdom | 134/180 |

*Primary Examiner*—Philip R. Coe

*Attorney, Agent, or Firm*—Harris Zimmerman; Howard Cohen

[57] ABSTRACT

A dish or glass washer having a sump for retention of rinse water for use in the subsequent wash cycle is formed as two modular units having a low profile wash and rinse chamber to fit under a counter on a sink drainboard and a connected power and control unit with a sump depending into a sink to dump water into the sink.

1 Claim, 2 Drawing Sheets

UNDER COUNTER GLASS WASHER

BACKGROUND OF THE INVENTION

Modern commercial dishwashers and glass washers operate at a lower water temperature by the use of a sterilizing agent and conventionally include a sump into which rinse water drains for recycling by a sump pump during the subsequent wash cycle. While this type of equipment comprises a substantial improvement over older machines that require preheated water it necessarily increases the minimum vertical dimension of the equipment by the depth of the sump and pump disposed therein.

Various applications of commercial dish and glass washing equipment encounter space limitations that limit the applicability of such equipment. One such application is in existing bars wherein limited space may be available and conventional equipment cannot be fitted under the counter or bar top above the sink drainboard normally positioned thereat.

The present invention provides an improved washer particularly adapted to fit beneath a bar top upon a sink drainboard.

SUMMARY OF INVENTION

The present invention provides a commercial washer for dishes or glasses having a particularly low profile so as to be readily fitted upon the drainboard of a bar beneath the bar top. This low profile is herein achieved by the provision of a modular unit having a first wash and rinse unit of low height adapted to sit upon a drainboard and a second power and control unit adapted to be connected to the first unit at either side thereof overhanging a sink and including a sump depending into such sink. There is thus provided an indirect drain via the existing sink and detachable water connections may be attached to existing sink tap or line so that the unit hereof may be readily installed without professional assistance so as to be truly portable and capable of readily relocation and inexpensive installation.

Internal washing and rinsing, as well as scrap removal, is all in accordance with widely tested and accepted practices in commercial equipment so that no added governmental approval or inspection is required. It is the physical arrangement of elements and side-by-side provision of modular units with depending sump which provides the low profile result enabling the present invention to be installed in areas of low height. This extends the capability of high quality commercial dish and glass washing together with guaranteed sterilization to existing bars, for example, wherein available equipment cannot readily be employed.

BRIEF DESCRIPTION OF DRAWINGS

The present invention is illustrated as to a particular preferred embodiment as thereof in the accompanying drawings, wherein.

DESCRIPTION OF PREFERRED EMBODIMENT

Figure 1:
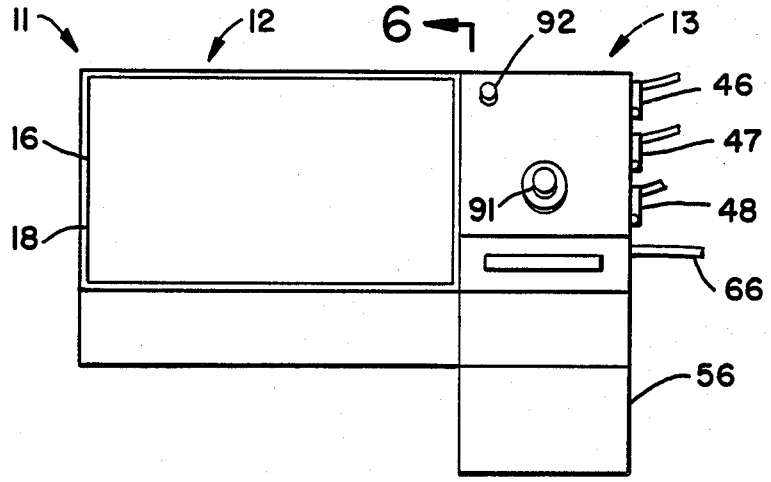
FIG. 1 is a front elevational view of a glass washer in accordance with the present invention.

The present invention provides a very low profile dish or glass washer which is adapted, for example, to fit under a bar top upon the drainboard of a sink. While the invention may be employed in various places it is particularly advantageous for installation in an existing bar wherein a limited space is available beneath the bar top and the top of a sink drainboard. It is also noted that while the present invention is applicable to the washing and sterilizing of dishes or glasses it is herein described with respect to a glass washer.

Referring now to the drawings, it will be seen that the glass washer 11 hereof is provided as a pair of modular units 12 and 13 adapted to be connected together in side-by-side relationship. The unit 13 is adapted to be attached to either side of the unit 12 for flexibility of installation.

Considering first the wash and rinse unit 12, it will be seen that same comprises a rectangular housing 16 defining an internal chamber 17 with a pivotably mounted front door 18 closing the front of the compartment. As illustrated, the front of the housing 16 is inclined outwardly from the top thereof for mounting of the door 18 in an inclined position from a horizontal hinge at the front of the housing and a vertical front wall extends downwardly beneath this hinge to a bottom or floor 19 of the housing. Within the compartment 17 there is provided a floor 20 that is inclined downwardly toward one side of the compartment for drainage of water therefrom. Within the wash and rinse unit 12 there is provide a rotary mounted wash and rinse arm 21 at the bottom of the compartment 17 above the floor 20. A water line 22 connects to this arm 21 for forcing water to the arm and upwardly through nozzles thereon for rotating the arm in the compartment 17. The pipe 22 extends laterally through a side of the housing 16 for connection to the modular unit 13, as described below. This pipe 22 may also extend to the opposite side wall of the housing for mounting of the unit 13 thereat. There is also provided internally of the unit 12 means for spraying water downwardly into the compartment 17 and this may comprise either a further rotary mounted arm or merely a pipe 23 extending about the top of the compartment 17 with openings or nozzles therein for spraying water downwardly into the compartment. The pipe 23 is also provided with a connection 24 extending through at least one side of the housing for connection to the modular unit 13, as described below.

The wash and rinse unit 12 is adapted to contain glasses, for example, to be washed and rinsed and to this end there are provided side rails 26 in the housing and immediately above the arm 21 for receiving a basket 27 having an open top and relatively open bottom. The basket is dimensioned to slide into and out of the compartment on the rails 26 while carrying glasses or the like 28.

The above described wash and rinse unit 12 of the present invention is relatively conventional with respect to the actual spraying of water or the like onto glasses, for example, carried by a removable basket. It is, however, noted that this suit has no sump but instead is provided with an opening 31 in the right side wall of the housing 16 at the bottom thereof for the drainage of water from the housing. The overall height of the unit 12 may be made quite small as of the order of eleven inches (11") to provide the capability of inserting the present invention beneath a bar top upon a drainboard, as further discussed below.

Figure 2:
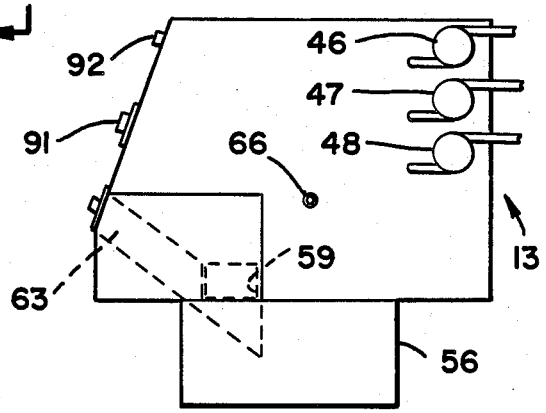
FIG. 2 is a side elevational view of the washer of FIG. 1.
Figure 5:
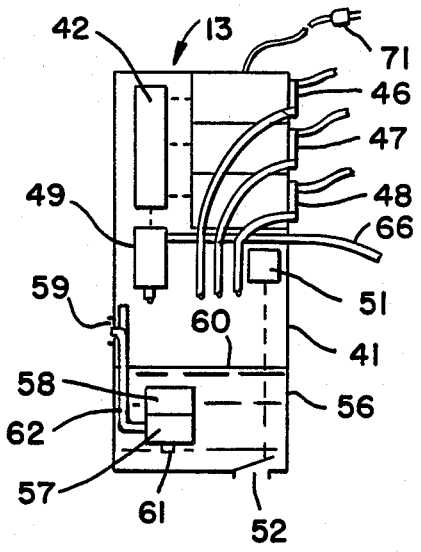
FIG. 5 is a front view of the control and power module of FIG. 1 with the front removed.
Figure 6:
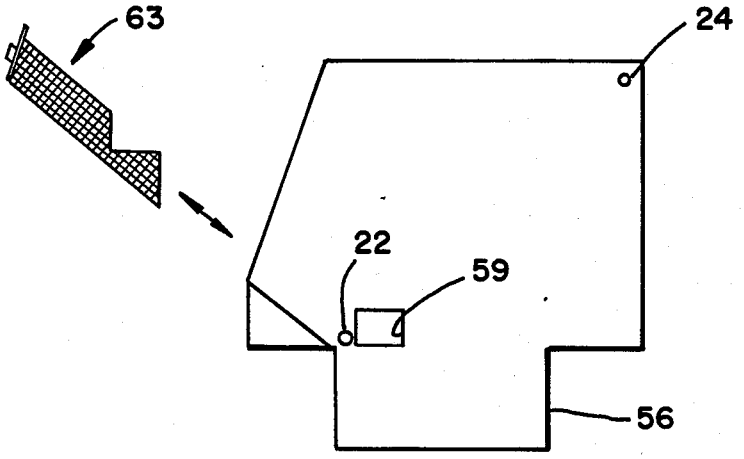
FIG. 6 is a sectional view taken in the plane 6—6 of FIG. 1.

Considering now the control and power unit or module 13 of the present invention and referring particularly to FIG. 5 of the drawings it will be seen that there is provided a housing of sheet metal or the like 41 within which there is provided adjacent to top thereof a control unit or element 42 and three dispensing pumps 46, 47 and 48. Also disposed within the upper portion of the module 13 is a fill valve 49 and a drain valve solenoid 51 connected to operate a drain valve 52 at the bottom of the unit 13. Further to this control unit 13 it is noted that the housing 41 depends downwardly to define a sump 56 within which there is disposed a pump 57 and a motor 58 for operating same. The housing 41 has an opening 59 in side thereof adapted to mate or communicate with the opening 31 in the module 11 for receiving water from the latter, as indicated by the water line 60 in the sump 56. The pump 57 has an inlet 61 communicating with the lower portion of the sump 56 and an outlet 62 adapted for connection the water pipe 22 of the first module 11 and also to the inlet connection 24 of the upper pipe 23 of the module 11. A scrap basket 63 of mesh or the like slides into the module 13 from the front thereof at an angle, as shown in FIG. 2, to receive water from the module 12 and strain scraps therefrom above the sump 56. A side of the basket is notched to allow water to freely flow into the basket 63 and then into the sump 56.

The elements described above with respect to the control unit or module 13 will be seen to compliment and provide power and control for the module 11 of the present invention. It is further noted that the water valve 49 of the module 13 is provided with an external 66 line which is adapted for connection to a faucet or the like in an existing installation adjacent a sink on which the present invention may be mounted. It is also noted that the water line 62 extending from the pump 57 of the module 13 is intended to be provided with a connection for the water lines 22 and 24 of the module 11 so that water pumped from the pump 57 will be forced through the wash and rinse arm 21 and upper arm or piping 23 of the module 11.

Having now considered the physical elements of the present invention, it is to be noted same are particularly adapted for mounting in a limited area having a low height such as under a counter of a restaurant or bar and upon a drainboard of a sink located thereat. In this respect reference is made to FIG. 3 of the drawings wherein there is illustrated a counter or bar 71 having a top 72 with a sink unit 73 disposed underneath same and including a drainboard 74 and plurality of sinks 76. Normally the spacing between the counter top or bar top 72 and the drainboard 74 in such an installation is of the order of twelve inches or slightly less and such installations are to be found throughout the United States in conventional bars or restaurants. In order for the present invention to be utilizable in such an installation it is necessary for the present invention to fit beneath the counter or bar top 72 and upon a drainboard 74 of the sink unit 73. The present invention is particularly adapted to this application wherein the total height of the present invention adapted fit upon such a drainboard 74 is no greater than eleven inches. Consequently the total height of module 11 is herein limited to eleven inches from the bottom 19 to the top of same. The module 13 on the other hand has a greater depth because of the inclusion therein of the sump 56 which depends from the upper portion of this module 13. This depending portion or sump 56 is, however, adapted to fit within a sink 76 of the sink unit 73 so that the total installed overall height of the modules 12 and 13 is no greater than eleven inches. Heretofore it is not been possible for any glass or dishwasher to fit within such a space of limited height.

Considering further an application of the present invention to the circumstance identified above, and referring again to FIG. 3, it will be seen that module 12 readily fits upon a drainboard 74 of a sink unit 73 beneath the counter top or bar top 72 of a unit 71. The module 13 is adapted to be attached to one side of the wash-rinse module 12 as by bolts extending between the units with nuts thereon available for tightening by the removal of a side wall of the unit or module 13. There are also provided conventional water fittings which may be of the quick connect type between the module 12 and 13 for connection of the water pipes 22 and 24 of the module 12 with the pump outlet 62 of the module 13.

Figure 3:
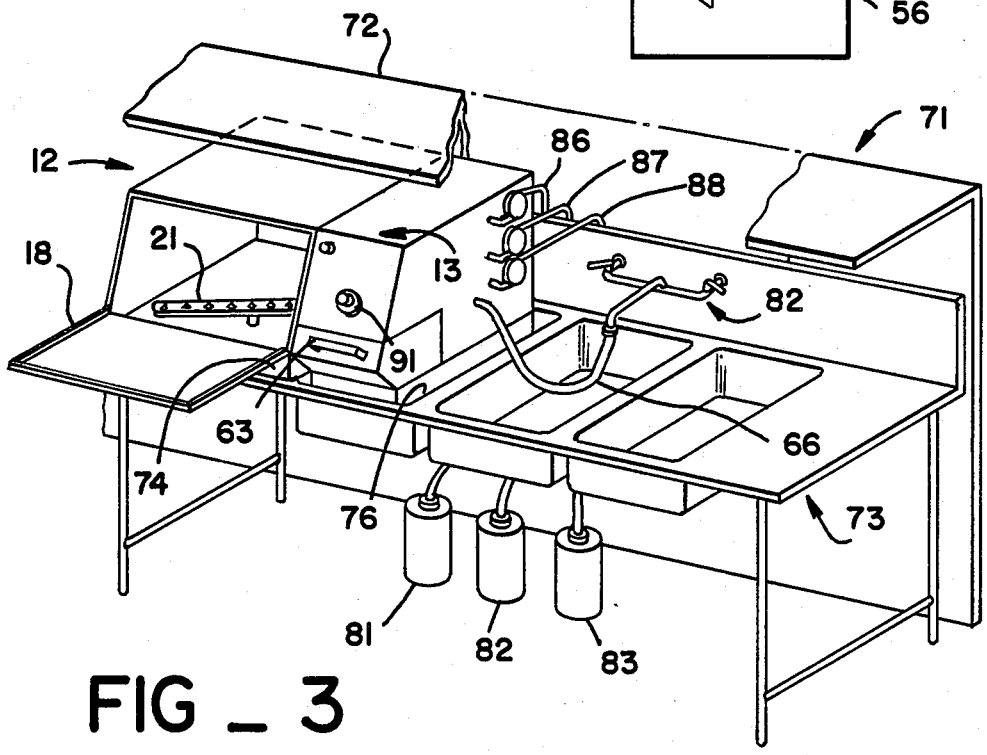
FIG. 3 is a projected view of the washer of FIG. 1 installed under a bar top upon a sink drain.
Figure 4:
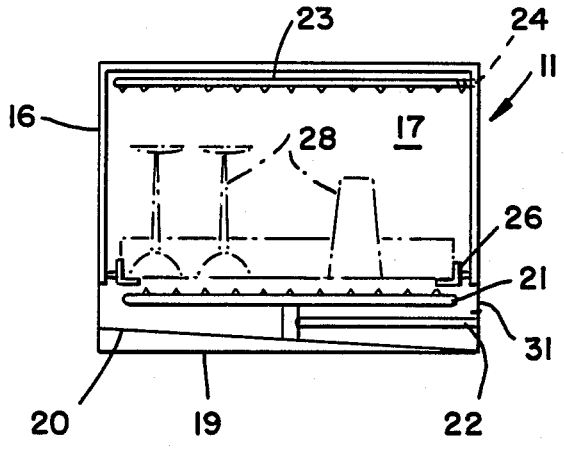
FIG. 4 is an internal view of the wash and rinse unit of FIG. 1 with the front thereof removed.

The installation of the present invention in the situation illustrated in FIG. 3 is readily accomplished by merely setting the module 12 upon the drainboard 74 and attaching the module 13 thereto with the sump 56 depending into a sink 76 of the unit 73. This attachment has been noted above as being provided by bolts and such attachment provides a communication between the modular units through the opening 31 in the unit 12 and the opening 59 in the unit 13. This then provides for the drainage of water from the unit 12 into the unit 13 and particularly into the sump 56 thereof. Electrical connection of the unit 13 may be readily accomplished by an electrical cord and connector 77 which may be plugged into a convenience outlet under the counter 72 and water connections may be completed by connecting the line 66 to a faucet 82, for example. Thus no permanent wiring or piping connections are required for installation or operation of the present invention. This will be seen to materially reduce the installation cost of the present invention in existing facilities.

In accordance with conventional operating procedures of glass and dishwashers, the pumps 46, 47 and 48 are connected to containers or reservoirs 81, 82 and 83 that may be disposed beneath the sink unit 73, for example, as by means of flexible hoses 86, 87, and 88 respectively. These containers 81, 82, and 83 are adapted to contain a detergent, a sanitizer and a drying agent respectively for use in the dish and glass washer of the present invention in accordance with general practices. These pumps 46, 47 and 48 are shown in FIG. 5 to have outlets or outlet lines leading to the sump 56 of the module 13 and the pumps are operated by the control unit 42 in timed sequenced to provided the above noted chemical to water in the sump.

With the foregoing installation which can be accomplished without professional assistance the present invention is ready to be operated in the existing space within a conventional bar for the washing, rinsing or sterilization of glass or dishes. It is only necessary for an operator to open a door 18 and draw the basket 27 out for insertion of glasses 28, for example, and then to move the basket into the compartment 17 and to close door 18 to ready the unit for operation. There is provided a start button 91 on the front face of the module 13 which would be then pressed to initiate a cycle of operation under control of the control unit 42 whereby water is forced through the wash arm 21 at the bottom of the compartment 17 and through the piping 23 at the top thereof with detergent in such water, as provided to the water in the sump 56 and pumped by the pump 57 so that the glasses 28, for example, are washed. At the end of the wash cycle, as determined by the unit 42, the drain valve 52 is opened by the solenoid unit 51 under control of the control unit 42 to drain the sump of wash water into the sink 76. The drain is then closed and fresh water is injected into the sump via the control valve 49. It is noted in the respect that the water dumped or drained from the sump 56 through valve 52 is dumped into the sink 76 so that no drain connections are required for the present invention. These sinks 76 of the sink unit 73 are already provided with hard connected drains to a sewer or the like. At this stage of operation of the present invention the control 42 operates the pump 57 to force fresh hot water through the wash arm 22 and upper piping 23 to rinse the glasses 28 in the module 12. Such rinse water has a sanitizer and a drying agent added by pumps 47 and 48. The water in the compartment 17 drains along the inclined floor 20 thereof back into the sump 56 of the module 13. At this stage of operation the glasses 28, for example, have been washed and rinsed and are ready to be removed from the washer hereof. Indication of the completion of the cycle may be provided by a light 92 mounted on the front face of the module 13 and possible as a part of the start button 91.

The foregoing sets forth the cycle of operation of the present invention and installation thereof. It will be appreciated from this description that the present invention is indeed truly portable inasmuch as it may be mounted and operated without the necessity of permanent connections inasmuch as no particular wiring or drain connections are required and it is not necessary to employ particular plumbing therefore. This will be appreciated to be highly advantageous to the user or owner of an installation in which the present invention is to be installed.

There has been described above a particular preferred embodiment of the present invention which may be modified or varied in various aspects. Thus, for example, the washer of the present invention need not necessarily be of the lower temperature type described above, however, it is highly advantageous to employ the latest technology and advances in the field wherein it is not necessary to preheat water employed for washing, and rinsing nor it is necessary to rely upon the existence of adequate water pressure in the inlet waterlines. Thus the present invention does incorporate a pump so water under desired pressure is always available to the wash and rinse module 12. Also the sump provides for reusing the rinse water as wash water in the next cycle of operation.

What is claimed is:

1. A low profile glass washer for use in conjunction with a drainboard adjacent to a sink having a drain wherein the drainboard and sink are spaced below a counter top such that a limited height is available between the drainboard and counter top, comprising:

a pair of modular units, including a first wash and rinse unit and a second control unit, each unit having side walls and means extending between said side walls for connecting one said unit to the other in side-to-side operative relationship;

said first unit including a first housing having a washing chamber for receiving glassware to be washed, and at least one wash and rinse arm in said chamber, said chamber having a flat exterior bottom wall for engaging on the drainboard and an inner bottom wall inclined toward a lower side opening for water drainage therefrom;

said second unit including a second housing, control means secured within said second housing for operating said first unit to clean the glassware by actuating consecutive wash and rinse cycles, said second housing further including a depending portion defining an enclosed sump, side opening means in said second housing for establishing flow communication between said sump and said washing chamber of said first unit, including a sump opening in said second unit side wall adjacent said first unit lower side opening for receiving drain water from said first unit;

said sump having sufficient liquid storage capacity to store substantially all the rinse water of one cleaning cycle for the wash water of the succeeding cleaning cycle;

said control means including means for retaining the rinse water of one cleaning cycle in said pump and for delivering said rinse water to said washing chamber as the washing water for the succeeding glassware washing procedure;

said first unit engaging the drainboard portion adjacent to the sink, said second unit extending over the sink, and said sump depending from said second unit into said sink for minimizing the height of said glass washer so that it is installable between the drainboard and counter top;

said sump including a drain valve for draining the contents of said sump directly to the exterior thereof, said control means including means for selectively opening said drain valve to drain said sump directly into the sink into which said sump depends; and said second unit having a front opening for receiving a mesh scrap basket slidably engaging said second unit and being positioned adjacent said sump inlet for retrieving scraps washed from said first unit with the drain water.

* * * * *